US007794296B2

(12) United States Patent
Nakagawa et al.

(10) Patent No.: US 7,794,296 B2
(45) Date of Patent: Sep. 14, 2010

(54) METHOD TO ASSEMBLE MARINE DRIVE SYSTEM, AND MARINE PROPULSION APPARATUS

(75) Inventors: Shigeaki Nakagawa, Amagasaki (JP); Toshio Imanaka, Amagasaki (JP)

(73) Assignee: Kanzaki Kokyukoki Mfg. Co., Ltd., Amagasaki-shi (JP)

( * ) Notice: Subject to any disclaimer, the term of this patent is extended or adjusted under 35 U.S.C. 154(b) by 0 days.

(21) Appl. No.: 10/906,882

(22) Filed: Mar. 10, 2005

(65) Prior Publication Data

US 2006/0063443 A1 Mar. 23, 2006

(30) Foreign Application Priority Data

Sep. 21, 2004 (JP) ..... 2004-273328

(51) Int. Cl.
*B63H 20/14* (2006.01)

(52) U.S. Cl. ..... 440/75; 464/83

(58) Field of Classification Search ..... 464/74, 464/76, 83; 440/75, 83; 74/411
See application file for complete search history.

(56) References Cited

U.S. PATENT DOCUMENTS

| | | | | |
|---|---|---|---|---|
| 2,326,450 A | | 8/1943 | Fawick | 64/14 |
| 2,500,723 A | * | 3/1950 | Ware | 74/411 |
| 4,308,728 A | * | 1/1982 | Croset | 464/83 |
| 4,311,028 A | * | 1/1982 | Brown et al. | 464/83 X |
| 4,714,448 A | * | 12/1987 | Focqueur et al. | 464/83 X |
| 4,795,402 A | * | 1/1989 | Reichardt | 464/74 |
| 5,357,231 A | | 10/1994 | Miwa et al. | 355/200 |
| 5,528,348 A | | 6/1996 | Miwa et al. | 355/211 |
| 6,045,448 A | * | 4/2000 | Kern et al. | 464/74 |
| 6,244,964 B1 | * | 6/2001 | Kirschey | 464/74 |
| 2002/0132673 A1 | | 9/2002 | Tabuchi et al. | 464/74 |

FOREIGN PATENT DOCUMENTS

| | | |
|---|---|---|
| DE | 196 23 184 | 12/1997 |
| EP | 0 861 993 | 9/1998 |
| EP | 0 902 204 | 3/1999 |
| GB | 983521 | 2/1965 |
| JP | 01-141942 | 9/1989 |
| JP | 06-095564 | 4/1994 |
| JP | 7-35150 | 2/1995 |
| JP | 2001-334993 | 12/2001 |
| JP | 2004-237851 | 8/2004 |

OTHER PUBLICATIONS

European Search Report mailed Apr. 10, 2007 (3 pgs.).
"Marine Engineering," The Society of Naval Architects and Marine Engineers, New York, NY, 1971; XP002426410 (pp. 383-393).
Japanese Office Action mailed Mar. 31, 2010 with English translation; (6 pages).

* cited by examiner

*Primary Examiner*—Greg Binda
(74) *Attorney, Agent, or Firm*—Kratz, Quintos & Hanson, LLP

(57) ABSTRACT

A method to assemble a marine drive system wherein an acceptable-unacceptable criterion on the torsional vibration of a shaft of the marine drive system is established based on the correlation between the torsional stiffness of a propeller shaft and the moment of inertia of a propeller. A desirable elastic coupling for the marine drive shaft is selected based on the criterion. The marine drive system is assembled by using a flywheel, a marine reverse and reduction gear, and an elastic coupling, whose property is changeable, lying between an input shaft of the marine reverse and reduction gear and the flywheel.

6 Claims, 6 Drawing Sheets

METHOD TO ASSEMBLE MARINE DRIVE SYSTEM, AND MARINE PROPULSION APPARATUS

TECHNICAL FIELD

The present invention relates to a method to assemble a marine drive system that transmits engine power, and to a marine propulsion apparatus.

BACKGROUND ART

Marine reverse and reduction gears usually comprise an input shaft, output shaft, and friction clutch between the input and output shafts. The input shaft is connected to a flywheel coupled to a drive shaft of the engine via an elastic coupling (for example, those disclosed in Japanese Unexamined Patent Publication No. 1995-35150 and Specification of U.S. Pat. No. 6,244,964), and the output shaft is connected to a propeller shaft. The output from the engine is transmitted to the propeller shaft via the drive shaft, flywheel, coupling and marine reverse and reduction gear. A marine drive system is composed of these components (for example, Specification of U.S. Pat. No. 4,679,673).

Each component of such a marine drive system is produced by a manufacturer specializing in the field (for example, in the case of a marine reverse and reduction gear, a manufacturer specializing in producing marine reverse and reduction gears). A ship building company then purchases them as parts and assembles the parts into a marine drive system. In some cases, a ship building company purchases an assembled flywheel, coupling, and marine reverse and reduction gear from an engine manufacturer and connects the assembly to a propeller shaft to complete a marine drive system.

However, there are various kinds of propeller shafts, propellers, etc., in the marketplace and they have different torsional vibration state.

Therefore, in prior art techniques, a test working is given after the completion of assembling, and if the torsional vibration of the marine drive system and rattle noise attributable to the torsional vibration are at an unacceptable level, the system has to be disassembled and the parts causing the problem have to be replaced.

DISCLOSURE OF THE INVENTION

An object of the present invention is to solve the problem of prior art techniques and provide a method to assemble a marine drive system, the method being capable of predicting undesirable torsional vibration of the marine drive system and preventing it. Another object of the invention is to provide a marine propulsion apparatus that, if the torsional vibration and/or noise are at an unacceptable level, can be repaired by making an adjustment thereto without replacing parts.

To achieve the above objects, the present invention provides a method to assemble a marine drive system, wherein the marine drive system is connected to an engine, an acceptable-unacceptable criterion for the torsional vibration of the shafting of the marine drive system is established based on the correlation between the torsional stiffness of the propeller shaft and the moment of inertia of the propeller, desirable components for the shafting are selected based on the criterion, and the components are assembled into the drive system.

The components of the shafting of the marine drive system are a propeller shaft and a propeller, wherein a propeller shaft having a desired torsional stiffness and a propeller having a desired moment of inertia are selected based on the criterion, and the selected components are assembled into the drive system.

The acceptable-unacceptable criterion can be established for every speed reduction ratio of the reduction gear of the marine reverse and reduction gear provided on the marine drive system.

The marine drive system comprises elastic couplings, which are characterized by being changeable property, and being disposed between an input shaft of the marine reverse and reduction gear and the flywheel. The elastic couplings may also be a component of the shaft of the marine drive system.

The elastic coupling comprises an outer ring fixed to the flywheel, an inner ring engaged with the input shaft, and an elastic block held between the outer ring and the inner ring, wherein at least one pair of opposing concave portions is disposed on the inner surface of the outer ring and the outer surface of the inner ring, the elastic blocks are detachably placed in the opposing concave portions in such a manner that each of both ends of the elastic block fits into each of the concave portions, a stopping member for preventing the elastic block from slipping off is detachably fixed to at least one of the inner ring and the outer ring, thereby allowing the desired elastic block to be selected and incorporated to freely change the property of the elastic coupling.

It is preferable that the elastic block be formed from a rubber block. It is also preferable that the hardness of the rubber block be selected in accordance with the acceptable-unacceptable criterion.

Alternatively, the degree of precompression of the rubber block may be selected based on the acceptable-unacceptable criterion.

By selecting at least one of the outer ring and the inner ring of the elastic coupling having a different concave degree from that of the concave portions mentioned above, the degree of precompression of the rubber block may be changed.

The component of the shaft of the marine drive system may be an additional mass disposed on the lower course of the elastic coupling in the direction in which power is transmitted, and the additional mass may be selected based on the acceptable-unacceptable criterion. In this case, the number of masses may be increased or decreased.

A chart diagramming the acceptable-unacceptable criterion may be used in the assembly method described above. The chart may appear in an assembly manual or specifications.

The above-mentioned objects are also achieved by a marine propulsion apparatus that serves as a marine drive system for transmitting the power of an engine, wherein the marine drive system comprises elastic couplings that are capable of changing their property and that are disposed between the input shaft of the marine reverse and reduction gear and the flywheel.

The elastic coupling of the marine propulsion apparatus comprises an outer ring fixed to the flywheel, an inner ring engaged with the input shaft, and an elastic block held between the outer ring and the inner ring, wherein at least one pair of concave portions is formed on the inner surface of the outer ring and the outer surface of the inner ring, the elastic block is detachably placed in the opposing concave portions in such a manner that each of both ends of the elastic block fits in each of the concave portions, a stopping member for preventing the elastic block from slipping off is detachably fixed to at least one of the inner ring and the outer ring, thereby allowing a desired elastic block to be selected and incorporated so that the property of the elastic coupling can be changed.

The elastic block of the apparatus may be a rubber block and so structured as to fit into each of the concave portions by varying the hardness of the rubber block.

The elastic block of the apparatus may be a rubber block and so structured as to fit into each of the concave portions by varying the degree of precompression of the rubber block.

The number of additional masses disposed on the lower course of the elastic coupling in the direction in which power is transmitted may be increased or decreased to vary the property of the elastic coupling.

The method to assemble a marine drive system of the present invention makes it possible to predict undesirable torsional vibration of the drive shafting and prevent the vibration by establishing an acceptable-unacceptable criterion for torsional vibration of the shafting of the marine drive system based on the correlation between the torsional stiffness of a propeller shaft and the moment of inertia of the propeller, selecting desirable components for the marine drive shafting system based on the criterion, and assembling the components.

Using a propeller shaft having a desirable torsional stiffness and/or a propeller having a desirable moment of inertia according to the criterion can prevent undesirable torsional vibration of the shafting.

The elastic coupling disposed on the shaft of the marine drive system has a great effect on torsional vibration of the drive shafting, and therefore undesirable torsional vibration of the shafting can be prevented by employing an elastic block having a desired hardness according to the above-mentioned criterion.

It is also possible to prevent undesirable torsional vibration of the shafting by increasing or decreasing the number of additional masses according to the criterion.

If the torsional vibration and/or noise of the drive shafting is at an unacceptable level during a trial run, the use of the marine propulsion apparatus of the present invention can bring the torsional vibration and/or noise of the shafting to an acceptable level by merely adjusting the property of the elastic coupling that is connected to the shaft without replacing the components of the marine drive system.

"Components constituting a shafting" in the present specification include a propeller shaft, a propeller, a elastic coupling, an additional mass and like peripherals, which prevent breakage of the marine reverse and reduction gear caused by undesirable torsional vibration and improve gear sound. This can also be applied to the claims.

BEST MODE FOR CARRYING OUT THE INVENTION

Embodiments of the method to assemble a marine drive system of the present invention will be explained below with reference to FIGS. 1 to 10. In the figures, the same reference numbers are used for the same constituent components. The marine drive system comprises a drive shaft 1 connected to an engine (not shown), a flywheel 2 fixed to the drive shaft 1, an elastic coupling 3, and a marine reverse and reduction gear 4. In the figures, the propeller shaft and propeller are omitted.

Figure 1:
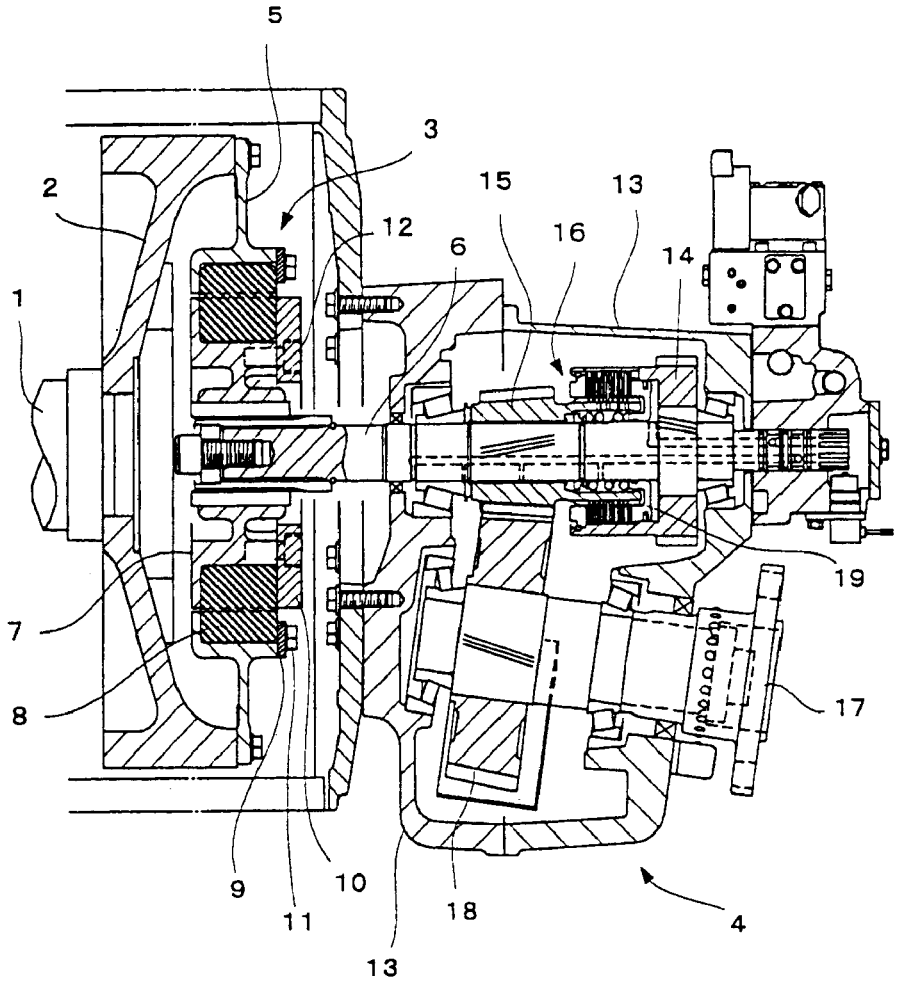
FIG. 1 is a longitudinal cross-sectional view showing the main parts of the marine drive system employing the method of the present invention.
Figure 3:
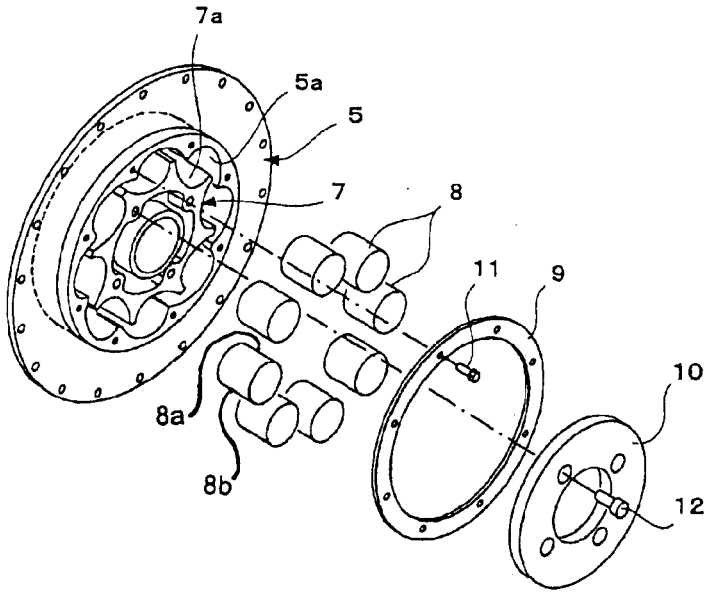
FIG. 3 is a perspective view showing an elastic coupling composing the marine drive system of FIG. 1.
Figure 4:
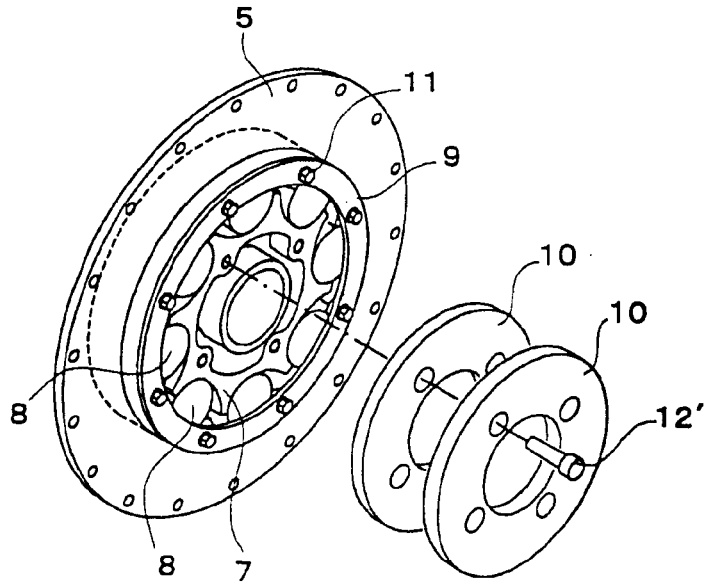
FIG. 4 is a perspective view showing an elastic coupling in an embodiment different from that of FIG. 3.

As shown in FIGS. 1, 3 and 4, the elastic coupling 3 comprises an outer ring 5 fixed to the flywheel 2, an inner ring 7 engaged with splines to the input shaft 6 of the marine reverse and reduction gear 4, and a plurality of elastic blocks 8 held between the outer ring 5 and the inner ring 7. Each elastic block is cylindrically shaped and has ends 8*a* and 8*b*, as shown in FIG. 3. An end, as defined in the present application, has the shape of a cylinder which has been truncated at a plane which contains a longitudinal axis of the cylinder. An opposing plurality of concave portions 5*a* and 7*a* are formed on the inner surface of the outer ring 5 and the outer surface of the inner ring 7, and the elastic blocks 8 are detachably placed in such a manner that an end of the elastic block 8 is fitted to the concave portion 5*a* and an other end of the elastic block 8 is fitted to the concave portion 7*a*. Furthermore, circular stopping members 9 and 10, which prevent the elastic block 8 from slipping off, are detachably fixed to the inner ring 7 and the outer ring 5 by bolts 11 and 12. The elastic blocks 8 may be cylindrically formed using rubber, such as synthetic rubber, etc.

In the embodiment shown in the figures, the stopping member 10 fixed to the inner ring 7 also serves as an additional mass. As shown in FIG. 4, a plurality of additional masses, i.e., a plurality of stopping members 10, may be fixed in layers using fixing bolts 12' having different lengths, in order to control the moment of inertia.

The marine reverse and reduction gear 4 comprises a casing 13, an input shaft 6 inserted in one of the openings of the casing 13, a forwarding housing gear 14 fixed to the input shaft 6, a forwarding pinion gear 15 rotatably attached to the outer surface of the input shaft 6, a friction clutch 16 disposed between the forwarding housing gear 14 and the forwarding pinion gear 15, an output shaft 17 to which the propeller shaft (not shown) extending from the other opening of the casing 13 is attached, and an output gear 18 fixed to the output shaft 17 and engaged with the pinion gear 15.

The friction clutch 16 can abrasively engage when a friction plate fixed to the housing gear 14 and a friction plate fixed to the pinion gear 15 engage with each other and are pressed by hydraulic pusher 19.

Figure 2:
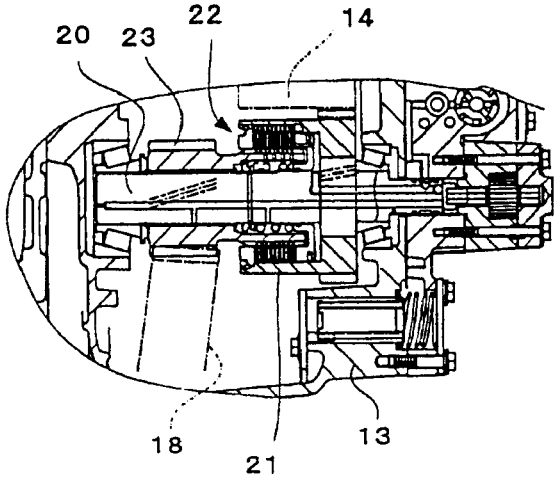
FIG. 2 is a longitudinal cross-sectional view showing the parts of the marine drive system of FIG. 1 seen from a different cross section.

As shown in FIG. 2, a support shaft 20 is disposed parallel to the input shaft 6 (FIG. 1). A retreating housing gear 21 fixed to the support shaft 20 is engaged with the forwarding housing gear 14. The retreating housing gear 21 can engage with the retreating pinion gear 23 that is rotatably attached to the outer surface of the support shaft 20 via the friction clutch 22. The retreating pinion gear 23 engages with the output gear 18.

The acceptable-unacceptable criteria shown in FIGS. 6 to 10 are used when assembling a marine drive system having the above-described structure. The acceptable-unacceptable criteria shown in FIGS. 6 to 10 are examples of diagram charts, and these charts may be published in assembly manuals or specifications.

In the charts, a criterial curve I defining an acceptable-unacceptable criterion on the torsional vibration of the shaft of the marine drive system is plotted on the rectangular coordinates, with the longitudinal axis representing the torsional stiffness of the propeller shaft and the horizontal axis representing the propeller moment of inertia.

This criterial curve I is established by obtaining a natural frequency for the torsional vibration based on the torsional stiffness of the propeller shaft and the propeller moment of inertia, and when the torsional stress calculated using the natural frequency of the torsional vibration exceeds the upper limit of the allowable stress level, it is evaluated as "unacceptable". When it falls within the allowable range of stress, it is evaluated as "acceptable". Such a calculation is done using a computer program, and Holzer analysis is generally employed. The safety factor for allowable stress is suitably selected so that undesirable torsional vibrations of the drive shafting and undesirable sound in the gears of the marine reverse and reduction gear can be prevented.

Figure 6:
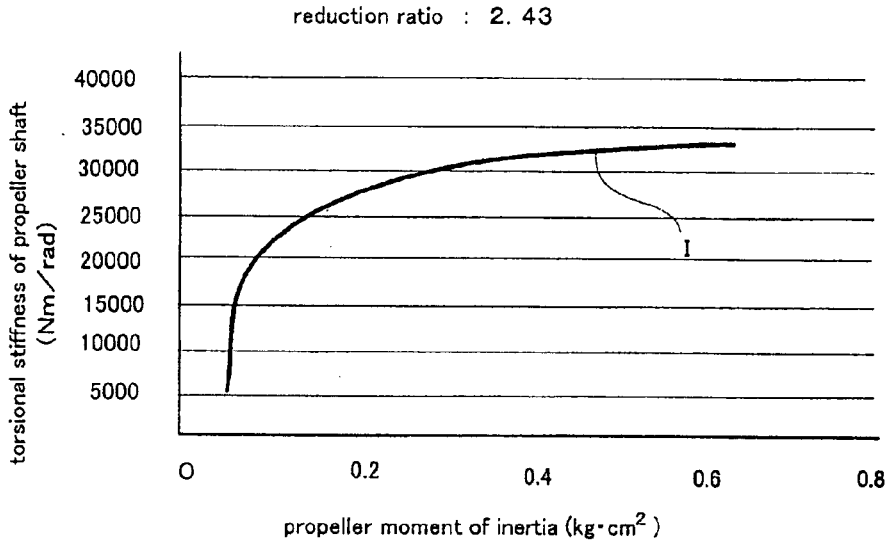
FIG. 6 shows one embodiment of the chart used in the method of the present invention.
Figure 7:
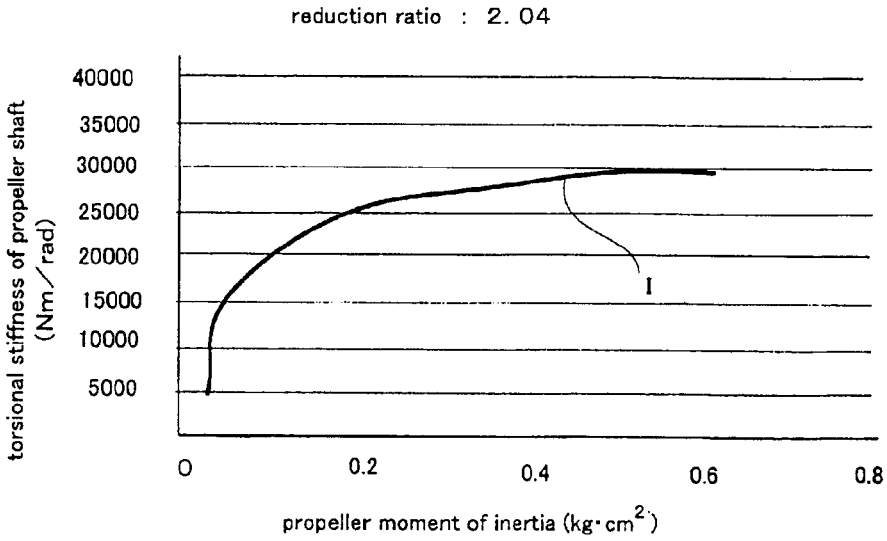
FIG. 7 shows one embodiment of the chart used in the method of the present invention.
Figure 8:
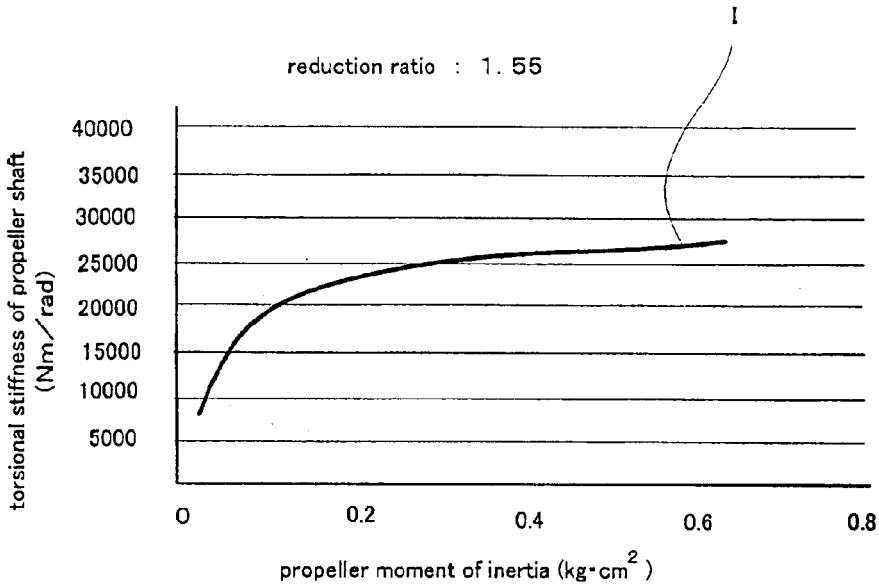
FIG. 8 shows one embodiment of the chart used in the method of the present invention

The charts shown in FIGS. 6 to 8 indicate the cases where the speed-reduction ratio of the pinion gears 15 and 23 to the output gears 18 is 2.43, 2.04, and 1.55, respectively. In the charts shown in FIGS. 6 to 8, the area above the criterial curve I is an unacceptable region and the area below the criterial curve I is an acceptable region.

For example, when the speed reduction ratio is 2.43, the torsional stiffness of the propeller shaft is 22773 (Nm/rad), and the propeller moment of inertia is 0.375 ($kg \cdot m^2$). In the chart shown in FIG. 6, this point falls in the region below the criterial curve I, and therefore undesirable torsional vibrations will be avoided.

When the speed reduction ratio is 2.04, the torsional stiffness of the propeller shaft is 33731 (Nm/rad), and the propeller moment of inertia is 0.219 ($kg \cdot m^2$). In the chart shown in FIG. 7, the point is above the criterial curve I, and therefore undesirable torsional vibrations of the shafting are anticipated. Therefore, in such a case, a propeller shaft having a desired torsional stiffness and/or propeller having a desired moment of inertia are selected and assembled so that the result falls below the criterial curve I, thereby preventing undesirable torsional vibrations of the shafting.

Figure 9:
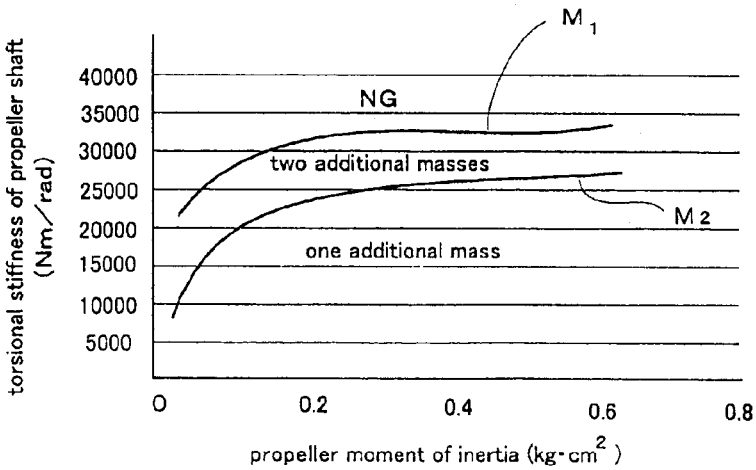
FIG. 9 shows one embodiment of the chart used in the method of the present invention.

FIG. 9 is a chart relating to the additional mass (stopping member 10). In the chart shown in FIG. 9, there are two criterial curves $M_1$ and $M_2$, wherein the part above of the criterial curve $M_1$ is an NG (no good) region. (The use of a propeller shaft having a torsional stiffness that falls in this region or a propeller having a moment of inertia that falls in this region is undesirable. In other words, if the result falls in this region, the occurrence of undesirable torsional vibrations is anticipated). In the region between the criterial curves $M_1$ and $M_2$, the use of two additional masses is recommended, and in the region below the criterial curve $M_2$, the use of one additional mass is recommended. Using the chart, undesirable torsional vibrations can be prevented by increasing or decreasing the number of additional masses. Note that the moment of inertia of one additional mass shown in FIG. 3 is, for example, 0.2 $kg \cdot m^2$.

FIG. 9 shows a chart in which the criterial curves for selecting a suitable number of additional masses are plotted; however, criterial curves for selecting a suitable moment of inertia, etc., for the additional masses regardless of the number of additional masses may also be plotted in a chart.

Figure 10:
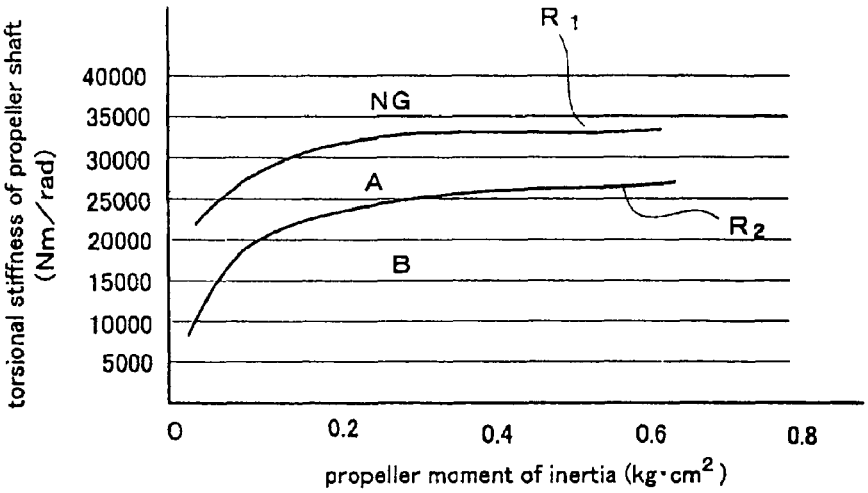
FIG. 10 shows one embodiment of the chart used in the method of the present invention.

The chart in FIG. 10 is related to elastic blocks 8. It has two criterial curves $R_1$ and $R_2$, wherein the part above the criterial curve $R_1$ is an NG region, the part between the criterial curves $R_1$ and $R_2$ is a region wherein an elastic block 8 having a specific hardness (in the example shown in FIG. 10, the hardness A of 75HS) is recommended, and the region below the criterial curve $R_2$ is the region wherein an elastic block 8 having different hardness (in the example show in FIG. 10, the hardness B of 80HS) is recommended. Therefore, according to this chart, by preparing elastic blocks having the two selected levels of hardness, it is possible to prevent undesirable torsional vibrations of the shafting. This is because the torsional stiffness of the elastic coupling has a great effect on the torsional vibrations of the shafting, and therefore torsional stiffness of the elastic coupling can be changed by varying the hardness of the elastic block.

As another method for changing the torsional stiffness of the shafting by varying the elastic block 8, a rubber block that composes the elastic block 8 may be incorporated in a precompressed condition. The precompressed rubber block can reduce the dynamic torsional stiffness of the elastic coupling by reducing the dynamic multiplication, which is the ratio between the dynamic torsional stiffness and the static torsional stiffness, of the elastic coupling compared to using a rubber block that is not precompressed.

Therefore, by plotting a criterial curve for selecting a suitable degree of precompression for the rubber blocks in the chart, and incorporating a rubber block that has been precompressed at a desired level according to the chart (not shown), torsional vibrations of the shafting can be prevented. Such a chart may show that, for example, in the region above the criterial curve, precompression is unnecessary, and in the region below the criterial curve, precompression is necessary.

To incorporate a rubber block in a precompressed condition, for example, the size of at least the concave portions 5*a* and 7*a* in the outer ring 5 and inner ring 7 which are in contact with the outer surface of a rubber block composing the elastic block 8 can be made smaller than the external diameter of the rubber block with no load applied. This will reduce the clearance between the concave portions 5*a*, 7*a* and the rubber block, and will cause precompression to be applied to the rubber block when incorporating it.

Figure 5:
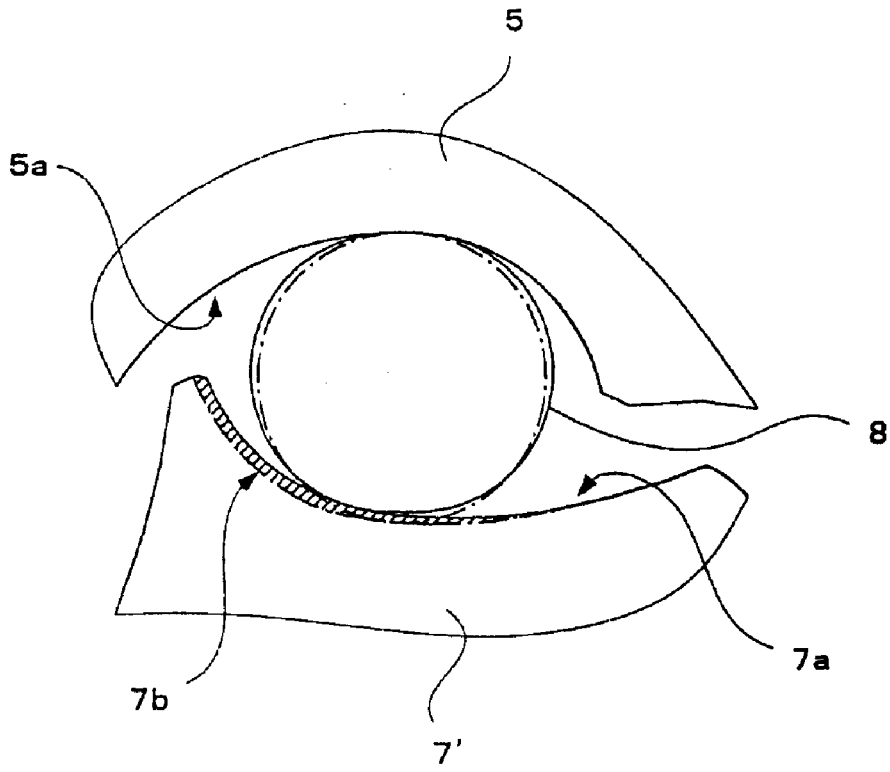
FIG. 5 is a front enlarged view of the rubber block of the elastic coupling.

FIG. 5 shows the specific mechanism for applying precompression to the rubber block. By using a portion 7' wherein an extended portion 7*b* (indicated by hatched lines) having a certain volume is provided on the surface of concave portion 7*a* of the inner ring 7, a circular rubber block is given an oval shape and then incorporated in the elastic block. This makes it possible to apply precompression to the rubber block. Therefore, by preparing a plurality of inner rings 7 having different degrees of concaveness in the extended portion 7*b* of the concave portion 7*a*, various precompression levels can be obtained.

Alternatively, rubber blocks having a desired external diameter, which is larger than the size defined by the concave portions 5*a* and 7*a*, may be prepared and incorporated into the elastic block in a precompressed condition.

In the above explanation, charts are exemplified as a tool for indicating acceptable-unacceptable criteria. However, it is also possible to constitute the present invention such that, for example, when the values of the torsional stiffness of the propeller shaft and the propeller moment of inertia are input into a computer program specifying the acceptable-unacceptable criteria, the values, property, and number of shafting components that can prevent undesirable torsional vibrations are displayed on the monitor.

What is claimed is:

1. A marine propulsion apparatus, that serves as a marine drive system for transmitting engine power, wherein the marine drive system comprises an elastic coupling, having an axis of rotation, with changeable property disposed between an input shaft of a marine reverse and reduction gear and a flywheel, and wherein the elastic coupling comprises an outer ring fixed to the flywheel, an inner ring engaged with the input shaft, and an elastic block held between the outer ring and the inner ring, with at least one pair of concave portions formed on the inner surface of the outer ring and the outer surface of the inner ring, the elastic block being detachably disposed on the concave portions facing each other in such a manner that one end of the elastic block fits into the concave portion of the outer ring and the other end of the elastic block fits into the concave portion of the inner ring, and having a stopping member that prevents the elastic block from slipping off and that is detachably fixed to at least one of the inner ring and the outer ring, thereby allowing a desired elastic block to be selected and incorporated to freely change the property of the elastic coupling, and further comprising at least one additional stopping member that is detachably fixed to the elastic coupling to provide stopping members lined up with each other in superimposed layers, each of said stopping members being disposed at the same end along said axis of rotation, to control the moment of inertia of the elastic coupling.

2. A marine propulsion apparatus according to claim 1, wherein the elastic block is a rubber block and is fitted into each of the concave portions by varying the hardness of the rubber block.

3. A marine propulsion apparatus according to claim 1, wherein the elastic block is a rubber block and is fitted into each of the concave portions by varying the degree of pre-compression of the rubber block.

4. A marine propulsion apparatus that serves as a marine drive system for transmitting engine power, wherein the marine drive system comprises elastic couplings, having an axis of rotation, with changeable property disposed between an input shaft of the marine reverse and reduction gear and the flywheel, and wherein the elastic coupling comprises:

an outer ring fixed to the flywheel;

an inner ring engaged with the input shaft; and an elastic block held between the outer ring and the inner ring, with at least one pair of concave portions formed on the inner surface of the outer ring and the outer surface of the inner ring, the elastic block being detachably disposed on the concave portions facing each other in such a manner that one end of the elastic block fits into the concave portion of the outer ring and the other end of the elastic block fits into the concave portion of the inner ring, and having a stopping member that prevents the elastic block from slipping off and that is detachably fixed to at least one of the inner ring and the outer ring, thereby allowing a desired elastic block to be selected and incorporated to freely change the property of the elastic coupling, and further comprising:

a stopping part connected to the inner ring and the outer ring at the other end, along an axis of rotation, to the stopping member, to prevent the elastic block from slipping off, wherein the stopping member is thicker than the stopping part to control the moment of inertia of the elastic coupling.

5. A marine propulsion apparatus according to claim 4, wherein the elastic block is a rubber block and is fitted into each of the concave portions by varying the hardness of the rubber block.

6. A marine propulsion apparatus according to claim 4, wherein the elastic block is a rubber block and is fitted into each of the concave portions by varying the degree of pre-compression of the rubber block.

* * * * *